US009718588B2

(12) United States Patent
Bates et al.

(10) Patent No.: US 9,718,588 B2
(45) **Date of Patent: *Aug. 1, 2017**

(54) CONTAINER FINISH FOR METAL LUG CLOSURE

(71) Applicant: Amcor Limited, Hawthorn (AU)

(72) Inventors: Peter Bates, Chelsea, MI (US); Bradley Wilson, Manchester, MI (US); Richard Steih, Jackson, MI (US); Luke A. Mast, Brooklyn, MI (US)

(73) Assignee: Amcor Limited, Hawthorn, Victoria (AU)

( * ) Notice: Subject to any disclaimer, the term of this patent is extended or adjusted under 35 U.S.C. 154(b) by 0 days.

This patent is subject to a terminal disclaimer.

(21) Appl. No.: 14/870,583

(22) Filed: Sep. 30, 2015

(65) Prior Publication Data

US 2016/0016696 A1 Jan. 21, 2016

Related U.S. Application Data

(63) Continuation of application No. 14/713,315, filed on May 15, 2015, which is a continuation of application No. 13/834,431, filed on Mar. 15, 2013, now Pat. No. 9,096,356.

(51) Int. Cl.

| | |
|---|---|
| ***B65D 41/04*** | (2006.01) |
| ***B65D 1/02*** | (2006.01) |
| ***B65D 85/72*** | (2006.01) |

(52) U.S. Cl.

CPC ..... *B65D 41/0464* (2013.01); *B65D 1/0207* (2013.01); *B65D 1/0246* (2013.01); *B65D 41/0442* (2013.01); *B65D 41/0471* (2013.01); *B65D 85/72* (2013.01); *B65D 2501/0036* (2013.01)

(58) Field of Classification Search

CPC .. B65D 41/0464; B65D 85/72; B65D 1/0207; B65D 41/0471; B65D 41/0442; B65D 2501/0036

USPC ..... 215/44, 329–331, 333, 337, 276; 220/288, 298, 300, 301

See application file for complete search history.

(56) References Cited

U.S. PATENT DOCUMENTS

| | | | |
|---|---|---|---|
| 1,516,046 | A | 11/1924 | Lee |
| 2,585,624 | A | 2/1952 | Bromley |
| 3,229,841 | A | 1/1966 | Bailey |
| 3,297,185 | A | 1/1967 | Plymale |
| 3,446,381 | A | 5/1969 | Podesta et al. |
| 3,465,908 | A | 9/1969 | Acton |
| 3,682,345 | A | 8/1972 | Baugh |
| 3,707,241 | A | 12/1972 | Taylor |
| 3,788,508 | A | 1/1974 | Vercillo |

(Continued)

OTHER PUBLICATIONS

International Search Report and Written Opinion dated Jun. 24, 2014 in corresponding International Patent Application No. PCT/US2014/023370 (twelve pages).

*Primary Examiner* — James N Smalley
(74) *Attorney, Agent, or Firm* — Harness, Dickey & Pierce, P.L.C.

(57) ABSTRACT

A container assembly including a container and a metallic closure. The container includes a polymeric body and a polymeric finish. The polymeric finish includes a plurality of threads. A lug lock is associated with each one of the plurality of threads. The metallic closure includes at least three metallic lugs configured to cooperate with the plurality of threads to couple the metallic closure to the polymeric finish.

20 Claims, 6 Drawing Sheets

(56) References Cited

U.S. PATENT DOCUMENTS

| | | | |
|---|---|---|---|
| 4,053,077 | A | 10/1977 | DeFelice |
| 4,084,717 | A | 4/1978 | King |
| 4,813,557 | A | 3/1989 | Herron et al. |
| 6,227,391 | B1 | 5/2001 | King |
| 6,841,117 | B1 | 1/2005 | Smith et al. |
| 7,942,287 | B2 | 5/2011 | King |
| 2005/0128870 | A1 | 6/2005 | Garcia |
| 2005/0242055 | A1 | 11/2005 | Oh |
| 2007/0045216 | A1 | 3/2007 | Gami et al. |
| 2007/0045320 | A1 | 3/2007 | Biesecker et al. |
| 2007/0175854 | A1 | 8/2007 | Penny |
| 2009/0236302 | A1 | 9/2009 | Labadie et al. |
| 2009/0283492 | A1 | 11/2009 | Molinaro et al. |
| 2012/0000879 | A1 | 1/2012 | McFarlane et al. |
| 2014/0263155 | A1 | 9/2014 | Szczesniak et al. |

FIG - 10
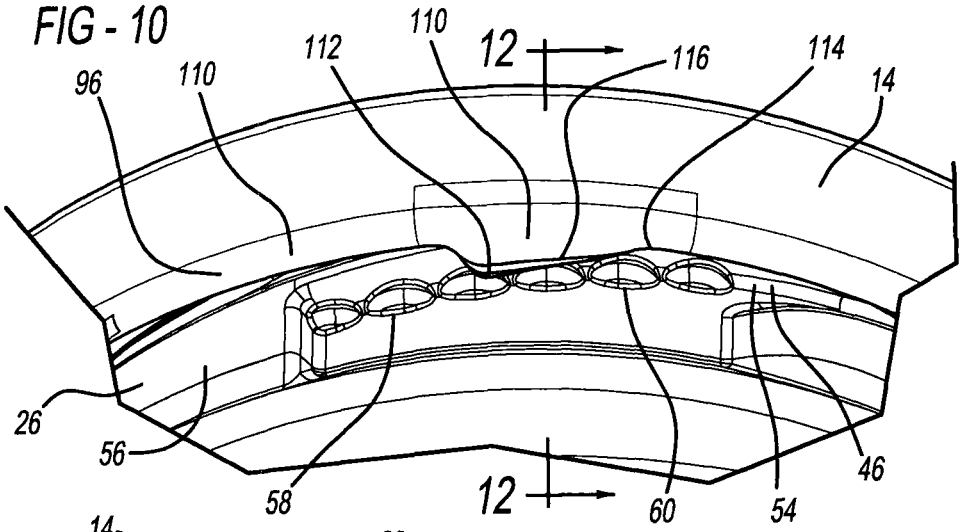
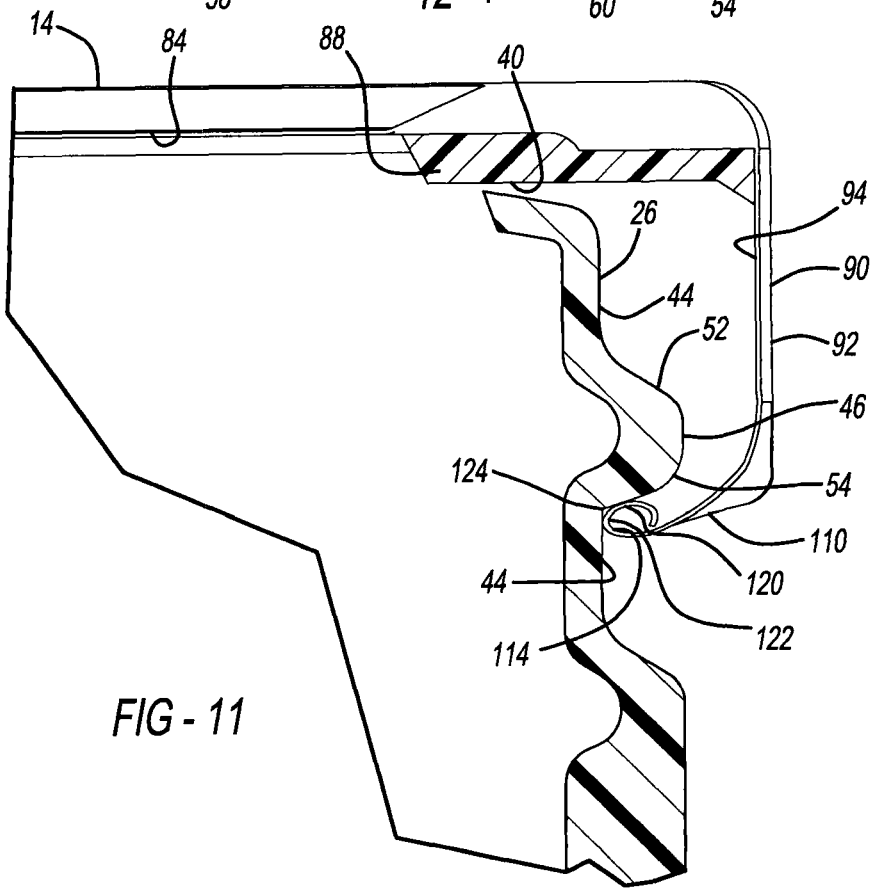
FIG - 11

CONTAINER FINISH FOR METAL LUG CLOSURE

CROSS-REFERENCE TO RELATED APPLICATION

This application is a continuation of U.S. patent application Ser. No. 14/713,315 filed May 15, 2015, which is a continuation of U.S. application Ser. No. 13/834,431 filed Mar. 15, 2015, now U.S. Pat. No. 9,096,356 issued Aug. 4, 2015. The entire disclosures of the above applications are incorporated by reference herein.

FIELD

The present disclosure relates to a container, and more specifically to a polymeric container with a metal lug closure.

BACKGROUND

This section provides background information related to the present disclosure, which is not necessarily prior art.

As a result of environmental and other concerns, plastic containers (more specifically polyester containers, such as polyethylene terephthalate (PET) containers for example) are now being used more than ever to package various commodities previously supplied in glass containers. Manufacturers and fillers, as well as consumers, have recognized that PET containers are lightweight, inexpensive, recyclable, and manufacturable in large quantities.

Blow-molded plastic containers have become commonplace in packaging numerous commodities. PET is a crystallizable polymer, meaning that it is available in an amorphous form or a semi-crystalline form. The ability of a PET container to maintain its material integrity relates to the percentage of the PET container in crystalline form, also known as the "crystallinity" of the PET container. The following equation defines the percentage of crystallinity as a volume fraction:

$$\%\ \text{Crystallinity} = \left(\frac{\rho - \rho_a}{\rho_c - \rho_a}\right) \times 100$$

where $\rho$ is the density of the PET material, $\rho_a$ is the density of pure amorphous PET material (1.333 g/cc), and $\rho_c$ is the density of pure crystalline material (1.455 g/cc). Once a container has been blown, a commodity may be filled into the container.

Various food products such as salsa, fruit and vegetable juices, nectars, etc. are often stored in glass containers, or in polymeric containers with a metal or polymeric closure, in order to increase their shelf life. To reduce costs and enhance the seal of the closure, for example, a cold-fill, hot-fill or hot-fillable PET, warm-fill, or retort container suitable for pasteurization in the range of 50° F.-250° F. that can couple with a metal closure would be desirable.

SUMMARY

This section provides a general summary of the disclosure, and is not a comprehensive disclosure of its full scope or all of its features.

The present teachings provide for a 50° F.-250° F. filled container assembly including a container and a closure. The container includes a polymeric body and a polymeric finish. The polymeric finish includes a plurality of threads. The closure includes a plurality of metallic lugs configured to cooperate with the plurality of threads to couple the closure to the polymeric finish.

The present teachings further provide for a container including polymeric body and a polymeric finish. The polymeric finish includes a plurality of threads. A lug lock is associated with each one of the plurality of threads. A metallic closure includes metallic lugs configured to cooperate with the plurality of threads to couple the metallic closure to the polymeric finish.

The present teachings also provide for a container assembly including a container and a closure. The container includes a polymeric body and a polymeric finish. The polymeric finish includes a plurality of threads and a strengthening member associated with each one of the plurality of threads that extends from an exterior surface of the finish to provide the polymeric finish with an increased thickness. The closure includes a plurality of metallic lugs configured to cooperate with the plurality of threads to couple the metallic closure to the polymeric finish to provide an air-tight seal between the metallic closure and the polymeric finish. Each one of the plurality of metallic lugs includes a leading end and a trailing end, the leading end extends further towards a center of the closure than the trailing end.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 10 illustrates cooperation between the closure and the finish of FIG. 1;

FIG. 11 is a cross-sectional view that illustrates cooperation between the closure and the finish of FIG. 1.

Corresponding reference numerals indicate corresponding parts throughout the several views of the drawings.

DETAILED DESCRIPTION

Example embodiments will now be described more fully with reference to the accompanying drawings.

Figure 1:
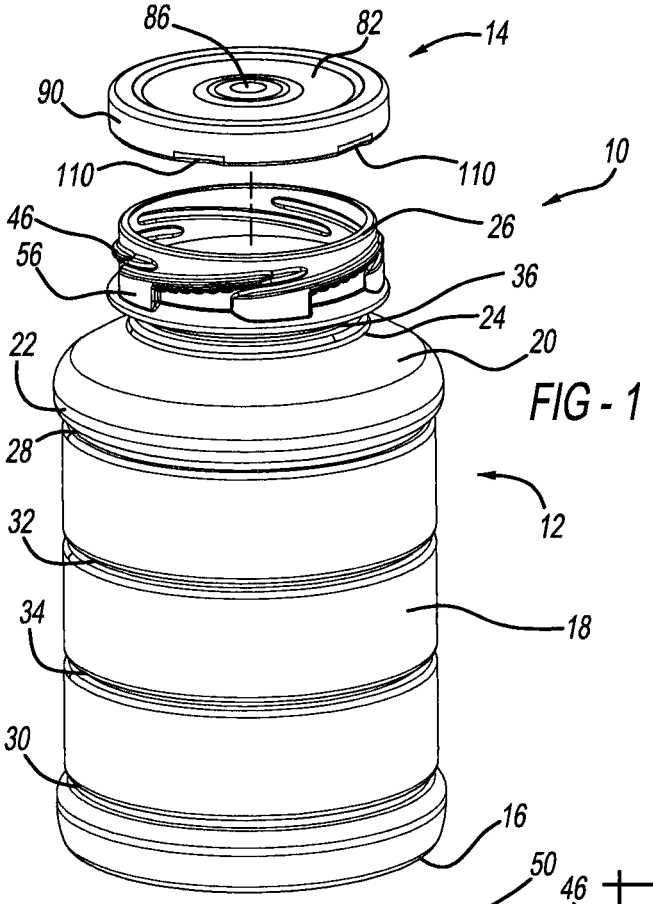
FIG. 1 is a perspective view of a container assembly according to the present teachings including a container and a closure.

With initial reference to FIG. 1, a container assembly according to the present teachings is illustrated at reference numeral 10. The container assembly 10 generally includes a container 12 and a closure 14, which is configured to couple with the container 12 as described herein. The container 12 can be made of any suitable material, such as a suitable polymer including polypropylene (PP), polyethylene terephthalate (PET), high-density polyethylene (HDPE), low-density polyethylene (LDPE), polyethylene naphthalate (PEN), a PET/PEN blend or copolymer, and various multi-layer structures.

The container 12 can have any suitable size and shape and can be configured to store any suitable liquid or solid therein, including any suitable food or condiment, such as salsa or sauce. The container 12 can be a hot-fill or hot-fillable container configured to receive hot-filled contents and suitable for pasteurization. The container 12 can be any suitable cold-fill, hot-fill, warm-fill or retort container suitable for pasteurization. The fill temperature range can be from 50° F.-250° F., such as at about 205° F. for hot-fill.

Any suitable manufacturing method for the container 10 can be used, such as, for example, extrusion blow molding, injection blow molding, or one step injection stretch blow molding. The container 10 can have a finish 26 formed by injection molding, or a finish 26 formed in the blow mold and then trimmed (blow-trim). The finish 26 can be formed in any suitable manner, such as to have a crystalized finish in the range of about 25% to about 35%. Those having ordinary skill in the art will readily know and understand plastic container manufacturing method alternatives.

The closure 14 can be made of any suitable metallic material, such as steel, tin, or aluminum. Because the closure 14 is made of metal, numerous advantages are realized. The metal closure 14 provides the container finish 26 with a 5-10% reduction in weight.

The container 12 generally includes a base 16 and a sidewall 18 extending from the base 16. At an end of the sidewall 18 opposite to the base 16 is a shoulder 20 of the container 12. The shoulder 20 includes a rim 22, which can have an outer diameter greater than an outer diameter of the sidewall 18. Extending from the shoulder 20 is a neck 24, and extending from the neck 24 is the finish 26.

The sidewall 18 defines a first recess 28, which extends about an outer diameter of the sidewall 18. The first recess 28 is proximate to the rim 22. The sidewall 18 further defines a second recess 30 proximate to the base 16, and third and fourth recesses 32 and 34 between the first recess 28 and the second recess 30. The second, third and fourth recesses 30, 32 and 34 are generally circular and extend about the outer diameter of the sidewall 18.

A rib 36 can be included with the neck 24 between the shoulder 20 and the flange 42 to isolate the finish 26 from undesirable squeezing of the container 12 at the sidewall 18. The rib 36 can flex and absorb forces applied to the container 12, such as when the container 12 is squeezed, to prevent the finish 26 from being distorted and assuming, for example, an oval shape. The rib 36 can act as an active hinge to absorb movement in both the horizontal and vertical planes, such as by collapsing and/or expanding. The rib 36 can have any suitable shape or configuration to absorb movement in the horizontal and vertical planes. For example, the rib 36 can have a general V-shape as illustrated, a U-shape, a semi-circular shape, a half-round shape, a shape resembling a rectangular notch, or any suitable irregular shape. The shoulder 20 can slope away from the rib 36 at any suitable angle, such as at an angle of about 30° (+/−10°) relative to a horizontal line extending from the rib 36, as illustrated in FIG. 2 at angle $X_1$.

Figure 2:
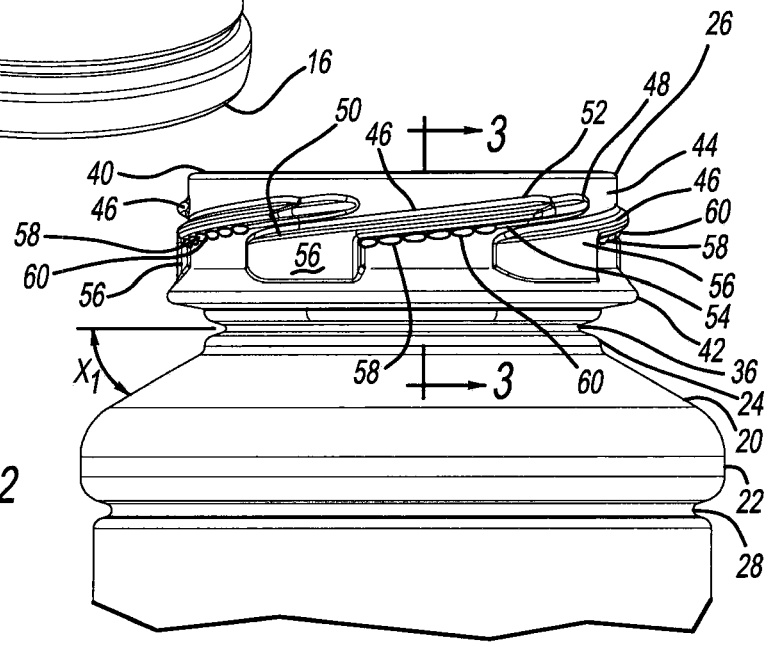
FIG. 2 is a side view of a finish of the container of FIG. 1.
Figure 3:
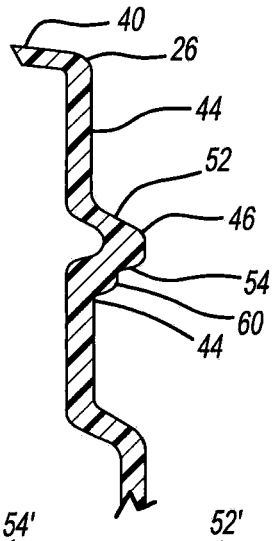
FIG. 3 is a cross-sectional view taken along line 3-3 of FIG. 2.

With continued reference to FIG. 1 and additional reference to FIGS. 2 and 3, the finish 26 includes an upper lip 40 and a flange 42. The upper lip 40 is generally circular and defines an opening of the finish 26 and of the container 12 generally. The flange 42 is proximate to the neck 24, and thus the upper lip 40 and the flange 42 are at opposite ends of the finish 26. The flange 42 strengthens the finish 26 to help prevent undesirable ovalization of the finish 26. The flange 42 also prevents material from being blown into the rib 36 and the neck 24 during manufacture. The flange 42 also provides additional support during transfer, filling and capping of the container 12.

The finish 26 includes an exterior surface 44. A plurality of threads 46 extend about, and outward from, the exterior surface 44. Each thread 46 includes a first end or leading end 48 and a second end or trailing end 50. The leading end 48 is closer to the upper lip 40 than to the flange 42. The trailing end 50 is closer to the flange 42 than the upper lip 40, or is generally equally distant between the upper lip 40 and the flange 42. Each thread 46 is thus generally angled and slopes downward toward the flange 42 from the leading end 48 to the trailing end 50. Each thread 46 further includes an upper surface 52 facing the upper lip 40 and an undersurface 54 generally facing the flange 42.

Any suitable number of threads 46 can be included at the finish 26. The number of threads 46 included will typically correspond to the number of lugs 110 (described herein) included with the closure 14. As illustrated, the finish 26 includes five threads 46, however, any suitable number of threads 46 can be included. The number of lugs 110 included with the closure 14 can depend on the size of the finish 26. For example, a 58 mm finish 26 can include three or four lugs 110; a 63 mm finish 26 can include four to six lugs 110; a 70 mm finish 26 can include five to seven lugs 110; and an 82 mm finish 26 can include five to nine lugs 110.

The finish 26 can further include a plurality of strengthening members 56. The strengthening members 56 are generally portions of the finish 26 that are thicker than surrounding portions of the finish 26. The strengthening members 56 extend or protrude outward from the exterior surface 44 to provide the finish 26 with a greater diameter at the strengthening members 56 than at areas of the finish 26 without the strengthening members 56. Any suitable number of strengthening members 56 can be included, and the strengthening members 56 can be provided at any suitable location about the finish 26. For example and as illustrated, a strengthening member 56 can be associated with each thread 46, such as at the trailing end 50 of each thread 46. The strengthening members 56 can be located at areas of the finish 26 where neighboring threads 46 overlap one another, such that the leading end 48 of one thread 46 overlaps a trailing end 50 of a neighboring thread 46. The strengthening members 56 can also act as thread stops to prevent over-tightening of the closure 14. More specifically, lugs 110 of the closure 14, which are described further herein, will contact the strengthening members 56 as the closure 14 is screwed onto the threads 46, and the lugs 110 will be stopped by the strengthening members 56 from moving further along the threads 46, thereby preventing the closure 14 from being screwed tighter onto the threads 46 and the finish 26.

The strengthening members 56 can extend between the threads 46 and the flange 42, as illustrated in FIG. 2 for example. The strengthening members 56 help prevent the finish 26 from being deformed, such as when the container 12 is squeezed. For example, the strengthening members 56 can help maintain the circular shape of the finish 26, and prevent the finish 26 from assuming an oval shape, such as when the container 12 is squeezed, which may break a seal between the closure 14 and the finish 26.

The finish 26 can further include a plurality of lug locks 58 to facilitate retention of the closure 14 to the finish 26. The lug locks 58 can be provided at any suitable location on the finish 26, such as at the undersurface 54 of each thread 46 as illustrated. The lug locks 58 can have any suitable configuration to retain a lug 110 of the closure 14 thereon, such as a plurality of ribs 60 extending along the undersurface 54 of each thread 46 between the leading and trailing ends 48 and 50 thereof. The ribs 60 provide a roughened surface that will help retain the lugs between two neighboring ribs 60 prevent the lugs 110 from sliding off of the threads 46.

Figure 4:
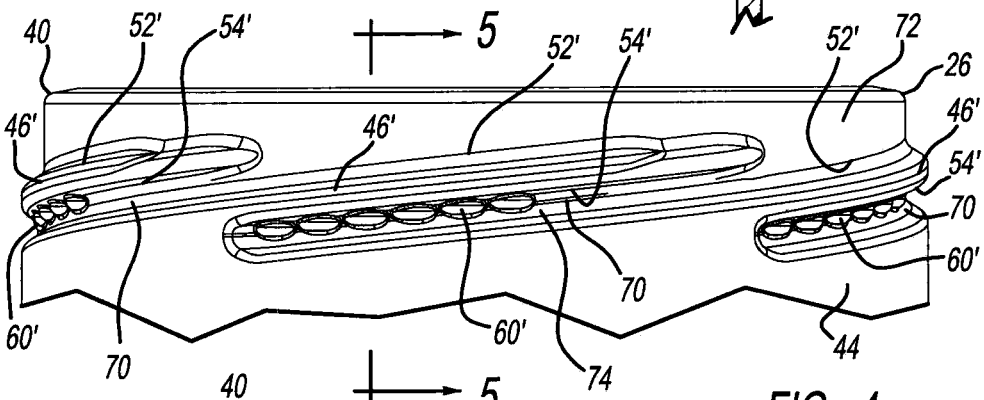
FIG. 4 is a side view of another container finish according to the present teachings.
Figure 5:
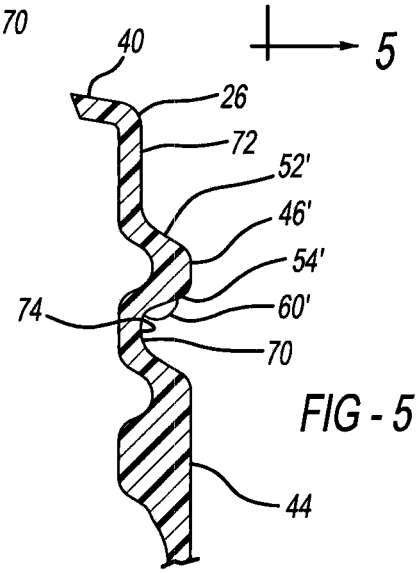
FIG. 5 is a cross-sectional view taken along line 5-5 of FIG. 4.

With additional reference to FIGS. 4 and 5, the threads 46 can be configured as threads or grooves 46'. Threads 46' do not extend outward from the exterior surface 44 of the finish 26 as illustrated in FIGS. 1-3 with respect to threads 46. Instead, the threads 46' are defined by grooves 70 formed within the exterior surface 44 of the finish 26. Features of the threads 46' that are similar or identical to features of the threads 46 are referenced in the figures with the same reference numbers but with the prime (') symbol. Because the threads 46' are defined by the grooves 70, the exterior surface 44 acts as a strengthening member, and thus the strengthening members 56 described above need not be included. At the upper surfaces 52' of the threads 46', the finish 26 includes a reduced diameter portion 72, which has an outer diameter smaller than the exterior surface 44. The reduced diameter portion 72 can be considered part of the exterior surface 44.

Figure 6:
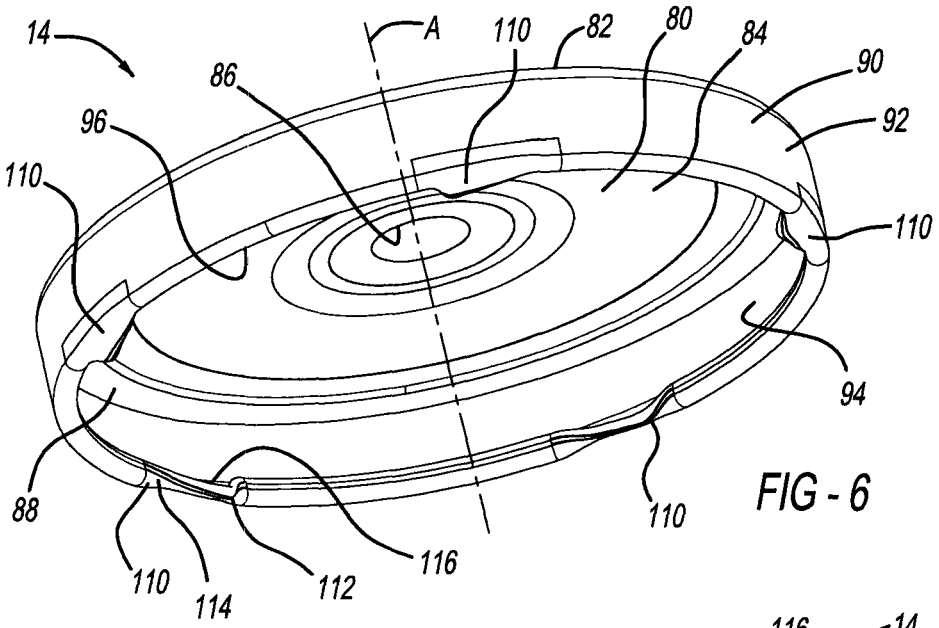
FIG. 6 is a perspective view of the closure of FIG. 1.
Figure 7:
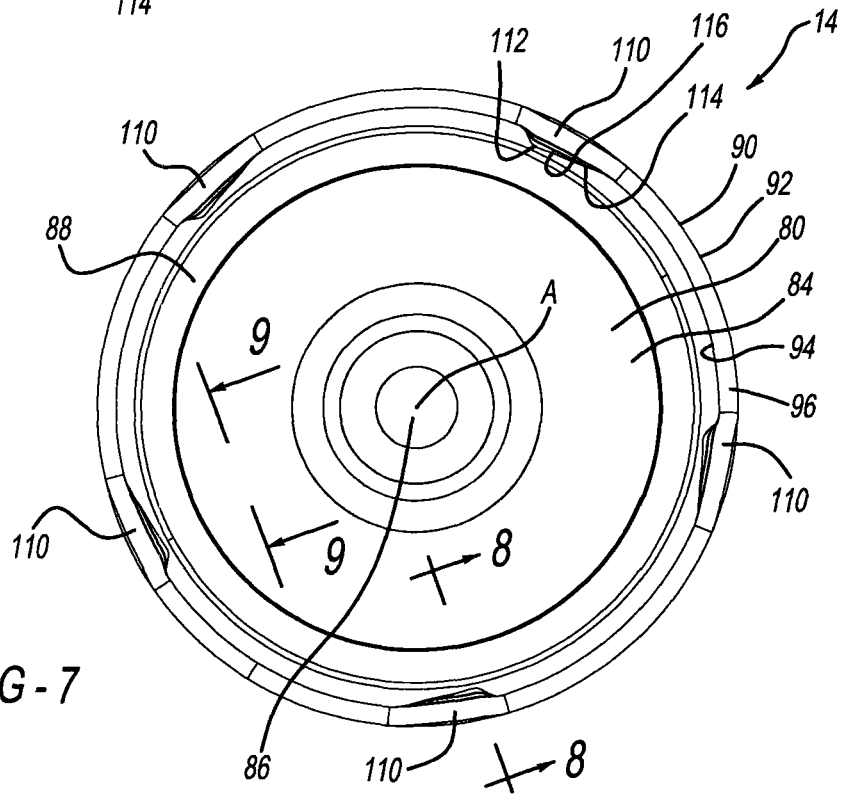
FIG. 7 is a plan view of an undersurface of the closure of FIG. 1.

With reference to FIGS. 6 and 7, the closure 14 of the container assembly 10 will now be described. The closure 14 includes a base 80, which includes an upper surface 82 and an undersurface 84. The base 80 is generally circular with an axis A extending through a center thereof. The center axis A extends through a flexible region 86 of the base 80, which can provide a seal indicator. The base 80 can include a seal member 88 proximate to the sidewall 90. The seal member 88 can be generally circular, and can extend about the center axis A of the base 80. The seal member 88 mates with the upper lip 40 of the finish 26 as described herein to seal the closure 14 to the finish 26.

Extending from an outer diameter of the base 80 at the undersurface 84 is a sidewall 90. The sidewall 90 includes an outer surface 92 and an inner surface 94, which is opposite to the outer surface 92. The sidewall 90 includes a rim 96 at an end of the sidewall 90 opposite to the base 80. The rim 96 is generally circular and extends about the center axis A of the base 80.

Figure 8:
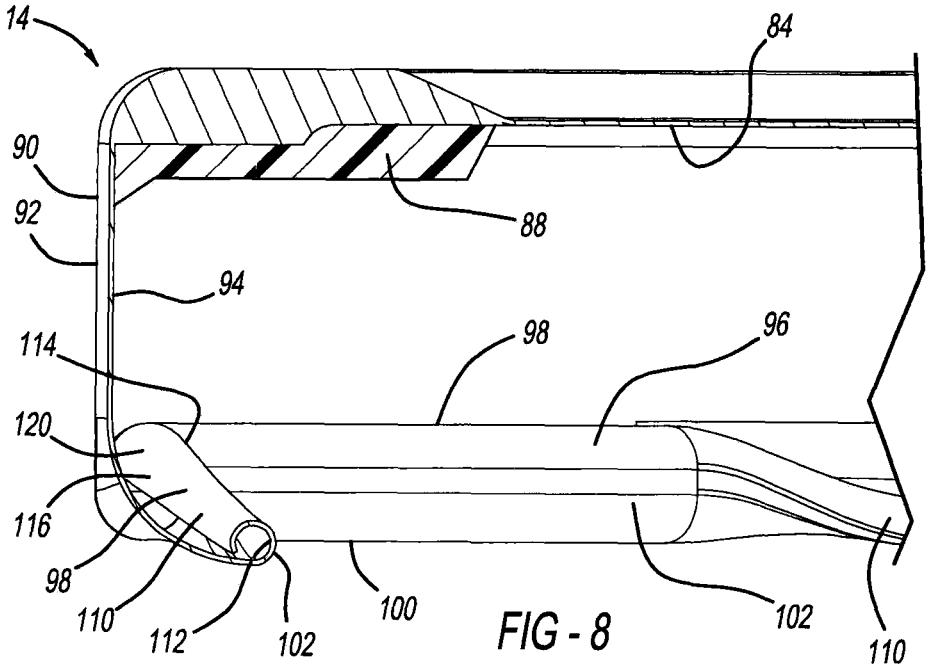
FIG. 8 is a cross-sectional view taken along line 8-8 of FIG. 7.
Figure 9:
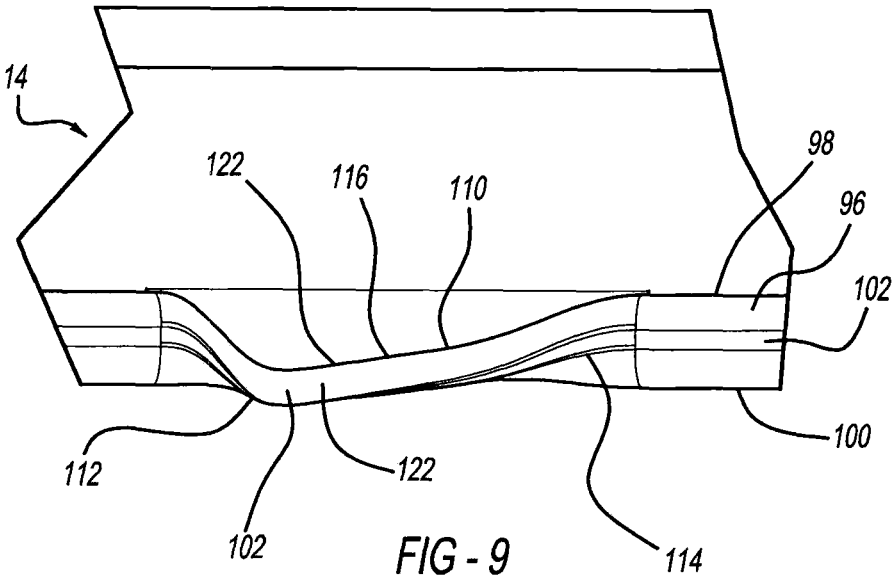
FIG. 9 is a view of an inner sidewall surface of the closure taken in the direction of line 9-9 of FIG. 7.

With continued reference to FIGS. 6 and 7, and additional reference to FIG. 8, the rim 96 includes an inner surface 98, an outer surface 100, and a side surface 102. The outer surface 100 is opposite to the inner surface 98. The rim 96 can be formed in any suitable manner, such as by a portion of the sidewall 90 that is curved or rolled inward towards the inner surface 98 of the sidewall 90.

The rim 96 includes a plurality of lugs 110. The lugs 110 can be evenly spaced apart along the rim 96, or arranged at any other suitable interval. Any suitable number of lugs 110 can be included, such as only five lugs 110, less than five lugs 110, or more than five lugs 110, such as six, seven, eight, or more lugs 110. Providing five or more lugs 110 results in numerous advantages, such as distribution of forces exerted upon the finish 26 as a result of the container being squeezed, which can prevent the shape of the finish 26 from being distorted.

Each lug 110 includes a first end or leading end 112 and a second end or trailing end 114. Extending between the leading end 112 and the trailing end 114 is an intermediate portion 116. Each lug 110 extends further from the sidewall 90 towards the center axis A at the leading end 112 than at the trailing end 114. Each lug 110 is angled and/or curved between the leading and trailing ends 112 and 114 corresponding to an angle and/or curve at which the threads 46 extend about the finish 26 so that the lugs 110 will generally continuously mate with the threads 46 along substantially their entire length.

To couple the closure 14 to the finish 26, the lugs 110 are positioned at the threads 46 and the closure 14 is rotated such that the lugs 110 slide along the undersurface 54 of each thread 46. The lugs 110 are arranged such that they contact the undersurface 54 of each thread 46 along substantially the entire length of the lugs 110 between the leading end 112 and the trailing end 114, as illustrated in FIGS. 10 and 11. The lugs 110 are configured to cooperate with the threads 46' in a similar manner, because the threads 46' can be dimensioned proportionate to the threads 46 or be provided with the same dimensions as the threads 46.

The lugs 110 can be formed in any suitable manner to arrange portions of the side surface 102 of the rim 96 closer to the center axis A at the lugs 110, as compared to portions of the side surface 102 between the lugs 110. For example, any device suitable for pulling or generally moving the rim 96 towards the axial center A so that the leading end 112 of the lugs 110 extends further towards the center axis A than the trailing end 114 may be used.

Cooperation between the closure 14 and the finish 26 will now be described in further detail. To secure the closure 14 to the finish 26, the closure 14 is arranged such that the sidewall 90 extends about the exterior surface 44 of the finish 26 with the inner surface 94 of the sidewall 90 facing the exterior surface 44 of the finish 26. Each lug 110 is arranged at a different one of the threads 46 such that the leading end 112 of each lug 110 abuts the undersurface 54 of each leading end 48 of the threads 46. The closure 14 is then rotated to slide the lugs 110 along the undersurface 54 of the threads 46 and move the lugs 110 towards the trailing ends 50 of the threads 46. As the lugs 110 slide along the undersurface 54 of the threads 46, the lugs 110 will also slide against and over the ribs 60. When the leading end 112 is between two ribs 60, interaction between the leading end 112 and the ribs 60 on either side thereof will help prevent the lug 110 from sliding off the threads 46 due to increased interference, thus loosening the coupling of the closure 14 to the finish 26.

As the closure 14 is rotated and the lugs 110 move along the undersurface 54 of the threads 46, the base 80 of the closure 14 moves toward the upper lip 40 of the finish 26. The seal member 88 at the undersurface 84 of the base 80 contacts the upper lip 40 of the finish 26 to provide an airtight seal between the closure 14 and the finish 26. The closure 14 can be rotated until the seal 88 cannot be further depressed against the lip 40, or until the lugs 110 contact the strengthening members 56 at the trailing end 50 of the threads 46 such that the lugs 110 are generally centered on each thread 46, such as relative to the length of the upper surface 52 of each thread 46. The lugs 110 are provided with an increased length to enhance cooperation between the lugs 110 and the threads 46, and to more easily center the lugs 110 on the threads 46. For example a standard lug with an approximate length of 0.55" can be increased by about 30% to a new length of about 0.7". With respect to the configuration of threads 46' of FIG. 4, the closure 14 can be tightened until the lugs 110 reach the end of the groove 70 associated with the threads 46' (FIG. 4).

Figure 12:
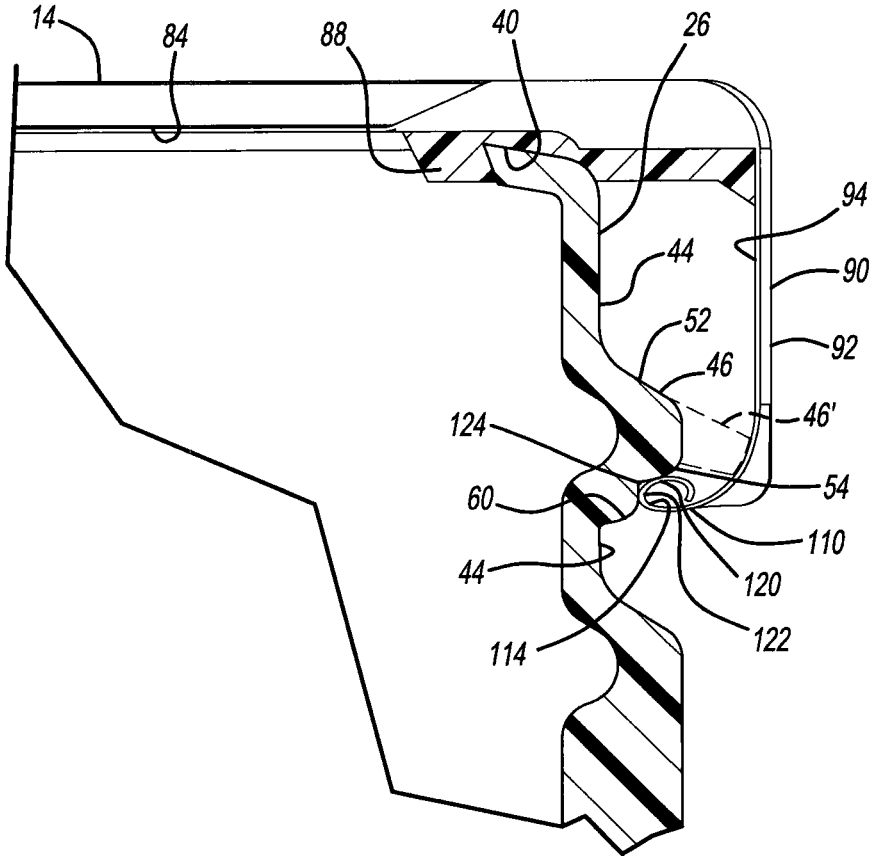
FIG. 12 is a cross-sectional view taken along line 12-12 of FIG. 10.

As illustrated in FIGS. 11 and 12 for example, each lug 110 contacts the thread 46 associated therewith at least at a first contact area 120, and contacts either the exterior surface 44 of the finish 26 (FIG. 11) or the ribs 60 (FIG. 12) at least at a second contact area 122. At the first contact area 120, contact occurs between the portion of the lugs 110 defined by the inner surface 98 of the rim 96 and the undersurface 54 of the threads 46. At the second contact area 122, there is contact between the portions of the lugs 110 defined by the side surface 102 of the rim 96 and the exterior surface 44 of the finish 26 (FIG. 11) or the ribs 60 (FIG. 12). A gap 124 may be defined between the first contact area 120 and the second contact area 122. The lugs 110 are angled and shaped to provide substantially continuous contact between the lugs 110 and the threads 46 to enhance fixation of the closure 14 to the finish 26. In some applications, one or more of the threads 46, such as thread 46' as illustrated in FIG. 12, may extend to a distance suitable to contact the inner surface 94 of the closure 14.

The present teachings allow the height of the finish 26 to be reduced, such as between the threads 46 and the upper lip 40, and between the threads 46 and the flange 42, thereby reducing the amount of material required for the finish 26, which conserves costs and reduces the overall weight of the container 12.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A container assembly comprising:

a container including a polymeric body and a polymeric finish, the polymeric finish including a plurality of threads and a lock lug associated with each one of the plurality of threads, each lock lug includes a plurality of ribs at an undersurface of each one of the plurality of threads; and a closure including:

a base;

a sidewall extending from the base;

a rim extending inward from the sidewall along an entire circumference of the sidewall towards a center axis extending through an axial center of the base; and a plurality of metallic lugs configured to cooperate with the plurality of threads to couple the closure to the polymeric finish, each one of the plurality of metallic lugs spaced apart along the rim and extending inward towards the center axis from the rim;

wherein each one of the plurality of metallic lugs is greater than about 0.55 inches in length.

2. The container assembly of claim 1, wherein when the closure is coupled to the container, each one of the plurality of metallic lugs is configured to simultaneously contact one of the threads and an exterior surface of the finish.

3. The container assembly of claim 1, wherein the polymeric finish includes a plurality of strengthening members that extend from an exterior surface of the finish, one of the plurality of strengthening members is associated with each one of the plurality of threads, the strengthening members provide a stop for the metallic lugs to prevent the metallic lugs from moving along the threads past the strengthening members and center the metallic lugs along the threads with respect to an upper surface of the threads.

4. The container assembly of claim 1, wherein:

the polymeric finish includes a number of threads equal to a number of the metallic lugs included with the closure; and each one of the plurality of metallic lugs extends both inwards towards a center axis of the closure and away from a base of the closure, and each one of the plurality of metallic lugs is configured to abut and cooperate with the plurality of threads along an entire length of each one of the plurality of metallic lugs.

5. The container assembly of claim 1, wherein the container assembly includes an equal number of threads and metallic lugs.

6. The container assembly of claim 1, wherein each one of the plurality of metallic lugs extends at an angle that generally parallels an angle at which the plurality of threads extend along the polymeric finish such that each lug is in contact with the thread associated therewith substantially along an entire length of each one of the plurality of metallic lugs when the lugs are coupled to the threads.

7. The container assembly of claim 1, wherein the polymeric finish includes five threads and the closure includes five metallic lugs evenly spaced apart about the closure.

8. The container assembly of claim 1, wherein the closure is made from a material selected from a group consisting of the following: steel, tin and aluminum; and wherein the polymeric finish is configured to cooperate with the closure, the polymeric finish having a weight 5-10% lighter as compared to a finish configured to cooperate with a plastic closure.

9. The container assembly of claim 1, wherein the closure includes a seal member at an undersurface thereof, the seal member configured to contact an upper lip of the polymeric finish when the closure is secured to the polymeric finish to provide an air-tight seal between the metallic closure and the polymeric finish.

10. A container assembly comprising:

a container including a polymeric body and a polymeric finish, the polymeric finish including a plurality of threads and a lock lug associated with each one of the plurality of threads, each lock lug includes a plurality of ribs at an undersurface of each one of the plurality of threads; and a closure including:

a base;

a sidewall extending from the base;

a rim extending inward from the sidewall along an entire circumference of the sidewall towards a center axis extending through an axial center of the base; and a plurality of metallic lugs configured to cooperate with the plurality of threads to couple the closure to the polymeric finish, each one of the plurality of metallic lugs spaced apart along the rim and extending inward towards the center axis from the rim;

wherein each one of the plurality of metallic lugs is about 0.7 inches in length.

11. The container assembly of claim 10, wherein when the closure is coupled to the container, each one of the plurality of metallic lugs is configured to simultaneously contact one of the threads and an exterior surface of the finish.

12. The container assembly of claim 10, wherein the polymeric finish includes a plurality of strengthening members that extend from an exterior surface of the finish, one of the plurality of strengthening members is associated with each one of the plurality of threads, the strengthening members provide a stop for the metallic lugs to prevent the metallic lugs from moving along the threads past the strengthening members and center the metallic lugs along the threads with respect to an upper surface of the threads.

13. The container assembly of claim 10, wherein:

the polymeric finish includes a number of threads equal to a number of the metallic lugs included with the closure; and each one of the plurality of metallic lugs extends both inwards towards a center axis of the closure and away from a base of the closure, and each one of the plurality of metallic lugs is configured to abut and cooperate with the plurality of threads along an entire length of each one of the plurality of metallic lugs.

14. The container assembly of claim 10, wherein the container assembly includes an equal number of threads and metallic lugs.

15. The container assembly of claim 10, wherein each one of the plurality of metallic lugs extends at an angle that generally parallels an angle at which the plurality of threads extend along the polymeric finish such that each lug is in contact with the thread associated therewith substantially along an entire length of each one of the plurality of metallic lugs when the lugs are coupled to the threads.

16. The container assembly of claim 10, wherein the polymeric finish includes five threads and the closure includes five metallic lugs evenly spaced apart about the closure.

17. The container assembly of claim 10, wherein the closure is made from a material selected from a group consisting of the following: steel, tin and aluminum; and wherein the polymeric finish is configured to cooperate with the closure, the polymeric finish having a weight 5-10% lighter as compared to a finish configured to cooperate with a plastic closure.

18. The container assembly of claim 10, wherein the closure includes a seal member at an undersurface thereof, the seal member configured to contact an upper lip of the polymeric finish when the closure is secured to the polymeric finish to provide an air-tight seal between the metallic closure and the polymeric finish.

19. A container assembly comprising:

a container including a polymeric body and a polymeric finish, the polymeric finish including a plurality of threads; and a closure including:

a base;

a sidewall extending from the base;

a rim extending inward from the sidewall along an entire circumference of the sidewall towards a center axis extending through an axial center of the base; and a plurality of metallic lugs configured to cooperate with the plurality of threads to couple the closure to the polymeric finish, each one of the plurality of metallic lugs spaced apart along the rim and extending inward towards the center axis from the rim;

wherein each one of the plurality of metallic lugs is greater than about 0.55 inches in length; and wherein when the closure is coupled to the container, each one of the plurality of metallic lugs is configured to simultaneously contact one of the threads and an exterior surface of the finish.

20. A container assembly comprising:

a container including a polymeric body and a polymeric finish, the polymeric finish including a plurality of threads; and a closure including:

a base;

a sidewall extending from the base;

a rim extending inward from the sidewall along an entire circumference of the sidewall towards a center axis extending through an axial center of the base; and a plurality of metallic lugs configured to cooperate with the plurality of threads to couple the closure to the polymeric finish, each one of the plurality of metallic lugs spaced apart along the rim and extending inward towards the center axis from the rim;

wherein each one of the plurality of metallic lugs is about 0.7 inches in length; and wherein when the closure is coupled to the container, each one of the plurality of metallic lugs is configured to simultaneously contact one of the threads and an exterior surface of the finish.

* * * * *